United States Patent [19]

Hale et al.

[11] Patent Number: 4,952,840

[45] Date of Patent: Aug. 28, 1990

[54] STRENGTHENING MEANS FOR A SIDEWALL OF A CUP-SHAPED MEMBER FOR AN ELECTRON GUN ASSEMBLY OF A CRT

[75] Inventors: John R. Hale; Gerald J. McCauley, both of Lancaster County, Pa.

[73] Assignee: RCA Licensing Corp., Princeton, N.J.

[21] Appl. No.: 325,840

[22] Filed: Mar. 20, 1989

[51] Int. Cl.[5] ..... H01J 29/48

[52] U.S. Cl. ..... 313/456; 313/451

[58] Field of Search ..... 313/457, 456, 451, 417

[56] References Cited

U.S. PATENT DOCUMENTS

| | | | |
|---|---|---|---|
| 2,888,588 | 5/1959 | Dichter . | |
| 3,267,316 | 8/1966 | Drake | 313/457 |
| 3,453,473 | 7/1967 | Oess | 313/451 |
| 3,722,043 | 3/1973 | Kirchner | 29/25.11 |
| 3,855,493 | 12/1974 | Snook et al. | 313/402 |
| 4,049,990 | 9/1977 | Collins | 313/417 |
| 4,049,991 | 9/1977 | Collins | 313/417 |
| 4,484,102 | 11/1984 | Hale | 313/417 |
| 4,595,858 | 6/1986 | Hale | 313/414 |
| 4,764,704 | 8/1988 | New et al. | 313/414 |

FOREIGN PATENT DOCUMENTS

WO83/01916 6/1983 World Int. Prop. O. .

*Primary Examiner*—Sandra L. O'Shea

*Attorney, Agent, or Firm*—Joseph S. Tripoli; Dennis H. Irlbeck; Vincent J. Coughlin, Jr.

[57] ABSTRACT

An electron gun assembly includes a plurality of cathode assemblies and a plurality of spaced successive electrodes mounted on at least two electrically insulative support rods. At least one of the electrodes comprises a deep-drawn substantially rectangular cup-shaped member having a base portion, a supporting flange portion, including a plurality of attachment tabs, and a sidewall extending therebetween. The sidewall includes a plurality of coined welding areas that provide a substantially flat welding surface having structural rigidity for securing studs thereto to facilitate attachment of the electrode to the support rods.

2 Claims, 1 Drawing Sheet

STRENGTHENING MEANS FOR A SIDEWALL OF A CUP-SHAPED MEMBER FOR AN ELECTRON GUN ASSEMBLY OF A CRT

BACKGROUND OF THE INVENTION

The present invention relates to an inline electron gun assembly for a plural beam cathode-ray tube (CRT) and, more particularly, to a structure for strengthening the sidewall of a cup-shaped member of such a gun assembly.

The electrode members of an inline electron gun assembly are serially arranged to accelerate and focus a plurality of electron beams along spaced, co-planar electron beam paths. The electrode members of the gun assembly are mechanically secured by means of attachment tabs and studs to at least a pair of insulative support rods which extend along the beam paths. Each of the electrode members commonly has several spatially-related apertures formed therein to accommodate the respective electron beams generated within the electron gun assembly. It is important that these several apertures be accurately located and aligned relative to the related apertures in adjacent electrode members, and to the respective electron generating surfaces. During the fabrication of the electron gun assembly, the attachment tabs and studs of the various electrode members are embedded into the temporarily heat-softened insulative support rods at which time the support rods on opposed sides of the gun assembly are pressured inwardly toward the electrode members to force the attachment tabs and studs into the support rods. The compressive pressure tends to exert a distorting force upon the several deep-drawn, cup-shaped electrode members which comprise the main focus lens of the electron gun assembly.

Most experience to date with conventional deep-drawn, cup-shaped electrodes, having sidewalls up to about 12.7 mm long, shows that these electrodes tend to develop a negative or concave "oil-canning" tendency, i.e., the sidewall of the electrode tends to bow inwardly toward the electron beam axes. When studs are welded to opposite sides of the sidewall of such electrodes, exact positioning and welding are difficult because of the variable slope and degree of negative "oil-canning" that occurs.

An even greater problem has been encountered in electron guns in which ultra-deep drawn, cup-shaped electrodes have sidewalls more than 12.7 mm long. In such ultra-deep drawn electrodes, a critical thinning of the sidewall occurs. The apex of the "oil-canning" in these electrodes occurs about 10.16 mm from the support flange located at the open end of the electrode. In the vicinity of the apex, the sidewall thins from the desired thickness of about 0.25 mm to about 0.19 mm. If the "oil-canning" is negative or concave on both sides of the sidewall, the problem of stud positioning is similar to that of the shorter deep-drawn electrodes described above; however, if the "oil-canning" of one side of the sidewall is positive or convex and the other side is negative or concave, or if both sides exhibit positive or convex "oil-canning," a new phenomenon occurs. During the beading operation, in which the insulative support rods are heated to a molten state and formed into contact with the attachment tabs and studs of the electron gun, the positive or convex "oil-canning" sidewall is forced inward by the stud attached to the sidewall of the previously convex surface.

The inward displacement of the previously convex sidewall acts like a loaded spring. As soon as the arms of the beading apparatus retract at the end of the beading cycle, the compressed sidewall of the electrode tends to return to its previous convex position forcing the insulative support rods, which are still in a plastic state, to bulge outwardly. Shear forces are thereby introduced into the insulative support rods during the cooling-deflection cycle, causing the support rods to crack in the vicinity of the attachment tabs or studs.

Even in electron guns in which the stress forces are not sufficiently great to crack the support rods, the varying degree of "oil-canning" of the sidewalls can cause a side-to-side displacement or offset of the ultra-deep drawn electrode relative to the other electrode members of the main focus lens. This results in a change of aperture locations relative to those in the adjacent electrode members, thereby producing deleterious inter-electrode spacing relationships and distortion in the electron beam trajectories.

U.S. Pat. No. 4,484,102, issued to J. R. Hale on Nov. 20, 1984, discloses a structure for strengthening the sidewall of a conventional deep-drawn electrode. The structure described therein comprises a wedge-shaped shoulder that is formed in opposite parallel sides of the sidewall of a deep-drawn substantially rectangular cup-shaped member. The wedge-shaped shoulder projects outwardly at an acute angle of about 45 degrees from the sidewall and extends into the supporting flange of the electrode adjacent to the attachment tabs. This structure is insufficient to prevent flexure of the sidewall of ultra-deep drawn electrodes.

U.S. Pat. No. 4,595,858, issued to J. R. Hale on Jun. 17, 1986, discloses a structure suitable for reinforcing either deep-drawn or ultra-deep drawn electrodes. A pair of reinforcing ribs are formed into each of the opposed parallel sides of the sidewall of the electrode to minimize flexure of the opposed sides in the vicinity of the studs, which are attached to the sidewall and embedded into the glass support rods, so as to minimize deleterious displacement, i.e., "oil-canning" of the electrode. However, the reinforcing ribs formed in the sidewall do nothing to provide a flat welding surface for the studs. Accordingly, a structure is desired which simultaneously strengthens the sidewall of the electrode while providing a flat surface for attachment of the studs.

SUMMARY OF THE INVENTION

An electron gun assembly for a cathode-ray tube includes a plurality of electrodes longitudinally spaced along and attached to a plurality of insulative support means. The electrodes include at least one substantially cup-shaped member having a base portion at one end, a supporting flange portion substantially parallel to said base portion at the oppositely disposed other end and a sidewall extending therebetween. Attachment means are secured to the sidewall to facilitate attaching the cup-shaped member to the insulative support means. The cup-shaped member is improved by forming therein strengthening means for providing a substantially flat welding surface having structural rigidity for securing the attachment means thereto.

DETAILED DESCRIPTION OF THE PREFERRED EMBODIMENT

Figure 1:
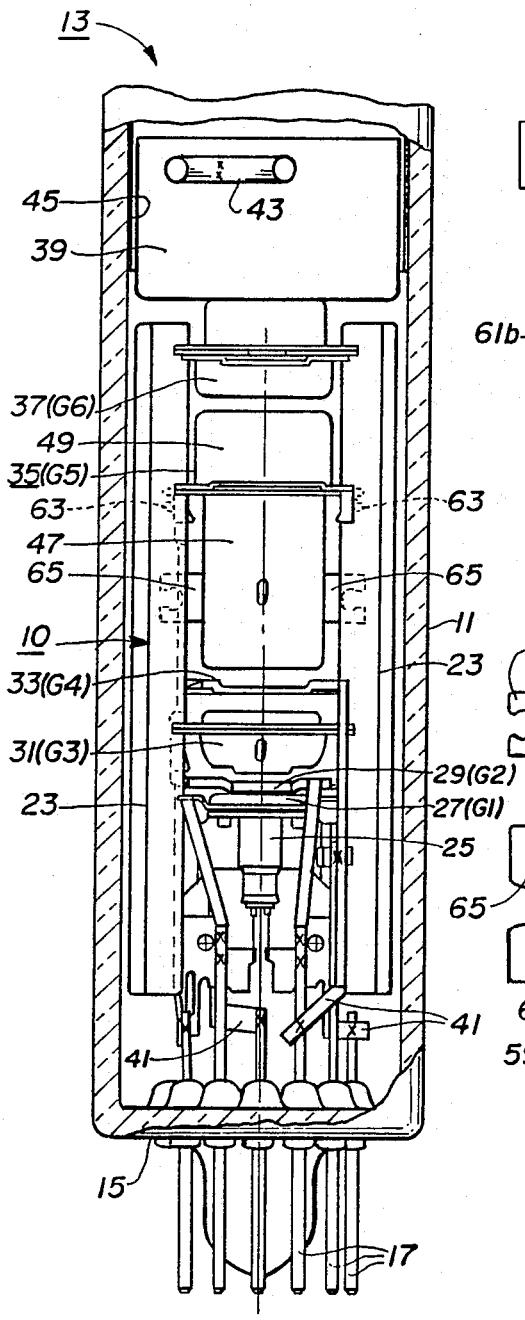
FIG. 1 is a partial broken-away side elevational view of an electron gun incorporating a novel cup-shaped electrode having strengthening means.

FIG. 1 shows structural details of an improved six-electrode inline electron gun assembly 10 centrally mounted in the neck 11 of a cathode-ray tube, CRT 13. The CRT 13 includes an evacuated envelope (not shown) closed at the neck end by a glass stem 15 having a plurality of leads or pins 17 extending therethrough. A faceplate (not shown), having a viewing screen, closes the other end of the envelope. A funnel (not shown) extends between the faceplate and the neck 11 of the envelope.

The inline electron gun assembly 10 is designed to generate and focus three electron beams along spaced, co-planar convergent beam paths having a common, generally longitudinal direction toward the viewing screen. The gun assembly 10 comprises two insulative support means 23 which are preferably glass support rods from which the various components are supported to form a coherent unit in a manner commonly used in the art. These components include three substantially equally transversely-spaced, co-planar cathodes 25 (one for producing each beam), a first electrode 27 (also referred to as G1), a second electrode 29 (also referred to as G2), a third electrode 31 (also referred to as G3), a fourth electrode 33 (also referred to as G4), a fifth electrode 35 (also referred to as G5), a sixth electrode 37 (also referred to as G6), and a shield cup 39, longitudinally-spaced, in that order, along the support rods 23.

The electrodes 35 and 37 form the main focusing lens of the electron gun assembly 10. The various electrodes of the gun assembly 10 are electrically connected to the pins 17 either directly or through metal ribbons 41. The gun assembly 10 is held in a predetermined position in the neck 11 on the pins 17, and with snubbers 43, on the shield cup 39, which press-on and make contact with an electrically conductive coating 45 on the inside surface of the neck 11. The conductive coating 45 extends over the inside surface of the funnel and is connected to an anode button (not shown). A conventional getter assembly (also not shown) is attached at one end to the cup 39 and extends in cantilever fashion in the funnel of the envelope.

Figure 2:
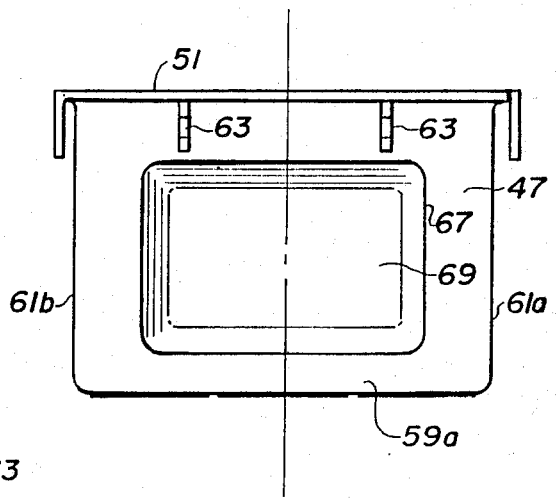
FIG. 2 is a front elevational view of the novel electrode of FIG. 1.
Figure 3:
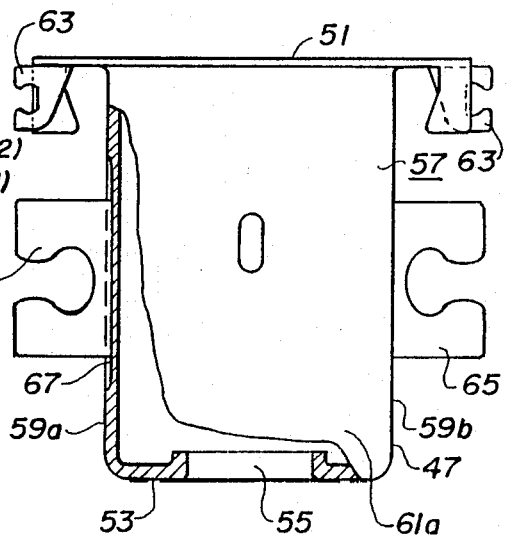
FIG. 3 is a partially broken-away side elevational view of the novel electrode.

The G5 electrode 35 comprises a focus electrode as does the G3 electrode 31 which is electrically connected to the G5 electrode. The focus electrode 35 comprises first and second substantially rectangular cup-shaped members 47 and 49, respectively. The cup-shaped members are joined together at their open ends. One of the cup-shaped members 47 is shown in FIGS. 2 and 3. The cup-shaped member 47 is a deep-drawn part comprising a supporting flange portion 51 located at the open end and a base portion 53 at the opposite end. The base portion 53 is substantially parallel to the supporting flange portion 51. Three inline apertures 55 are formed through the base portion 53, although only one aperture is shown in FIG. 3. A sidewall 57, having substantially parallel opposed sides **59*a* and 59*b* and opposed end portions 61*a* and 61*b*, extends between the supporting flange portions 51 and the base portion 53 of the cup-shaped member 47. A plurality of attachment tabs 63 are formed in the supporting flange portion 51 adjacent to the opposite sides 59*a* and 59*b* of the sidewall 57 to facilitate attachment of the cup-shaped member 47 to the glass support rods 23. As shown in FIGS. 1 and 3, a pair of studs 65 are attached to the sidewall 57 of the cup-shaped member 47, one stud to each of the opposed sides 59*a* and 59*b*. The studs 65 and the attachment tabs 63 are embedded into the support rods 23. As described previously, deep-drawn electrodes, such as the cup-shaped member 47**, have a tendency to "oil-can", i.e. bow either inwardly or outwardly, unless the sidewall is strengthened. One means of strengthening or reinforcing the sidewall is described in the aforementioned U.S. Pat. No. 4,595,858, issued to Hale. In that patent, a pair of reinforcing ribs are formed into each of the opposed sides of the sidewall. However, the reinforcing ribs do not provide a flat support surface for attaching the studs to the sidewall, with the result that some side-to-side displacement or offset of the deep-drawn electrode occurs relative to the other electrodes of the electron gun occurs. This provides some distortion in electron beam trajectories.

The present invention addresses both the problem of strengthening the opposed sides **59*a* and 59*b* of the sidewall 57 of the deep-drawn cup-shaped member 47, as well as that of providing a flat, geometrically consistent welding surface for the attachment of the studs 65. A coined welding area 67 is formed in each of the opposed sides 59*a* and 59*b* of the sidewall 47. The coined area 67 is centrally located in each of the opposed sides 59*a* and 59*b*, and is slightly larger in size than the studs 65 to permit the studs to be located within an innermost portion 69 of the coined area. "Coining", as is known in the art, is the process of forming metal by squeezing between two dies so as to impress a well-defined imprint on one or both surfaces. With the cup-shaped electrode member 47 positioned on the last extruding die (not shown), a pair of dies (also not shown) contact the opposed sides 59*a* and 59*b* to squeeze the portions 67 of the sidewall therebetween to imprint the substantially flat, geometrically consistent welding surface 69 therein. The "coining" work-hardens and strengthens the affected portions of the sidewall 57 while providing substantially flat welding surfaces for the attachment of the studs 65. The coined area 67 is shown in FIG. 3 as formed only in the exterior surface of the side 59*a***. An inward projection of the coined area can be achieved by having a mating recess formed in an inner die; however, the present structure is cost effective and provides the necessary structural strength or rigidity and flatness.

What is claimed is:

1. In an electron gun assembly for use in a cathode-ray tube, said gun assembly including a plurality of electrodes longitudinally spaced along and attached to a plurality of insulative support means, said electrodes including at least one substantially cup-shaped member having a base portion at one end, a supporting flange portion substantially parallel to said base portion at the oppositely disposed other end and a sidewall extending therebetween, and attachment means secured to said sidewall to facilitate attaching said cup-shaped member to said insulative support means, the improvement wherein said sidewall includes at least one coined weld area formed therein for providing a substantially flat welding surface having structural rigidity for securing said attachment means thereto.

2. In an inline electron gun assembly for use in a cathode-ray tube, said gun assembly including three co-planar cathodes, a G1 electrode, a G2 electrode and at least two focus electrodes longitudinally spaced along and attached to at least two glass support rods, at least one of the focus electrodes comprising a first and a second substantially rectangular cup-shaped member joined together at their open ends, at least one of said cup-shaped members having a supporting flange portion located at the open end and a base portion located at the opposite end, said base portion being substantially parallel to said supporting flange portion and being connected thereto by a sidewall having opposed sides and opposed end portions, said base portion having three inline apertures therethrough, at least two studs being attached to said sidewall, one stud being attached to each of said opposed sides, said studs being embedded into said glass support rods to secure said cup-shaped member thereto, the improvement wherein said sidewall includes a pair of coined welding areas formed in each of said opposed sides of said sidewall to strengthen said sidewalls and to provide a geometrically consistent, substantially flat welding surface for attachment of said studs.

* * * * *